United States Patent [19]

Stout

[11] 4,301,201

[45] Nov. 17, 1981

[54] SKI POLE SHAFT

[75] Inventor: Thomas C. Stout, Concord, Mass.

[73] Assignee: Trail Equipment Company, Inc., Concord, Mass.

[21] Appl. No.: 143,889

[22] Filed: Apr. 25, 1980

Related U.S. Application Data

[63] Continuation of Ser. No. 25,405, Mar. 30, 1979, abandoned.

[51] Int. Cl.[3] ..... B32B 1/08; B32B 5/28

[52] U.S. Cl. ..... 428/36; 280/819; 428/114; 428/220; 428/295; 428/367; 428/392; 428/902

[58] Field of Search ..... 428/36, 367, 902, 222, 428/392, 295; 280/809, 819; 273/80 R

[56] References Cited

U.S. PATENT DOCUMENTS 2,573,361 10/1951 Rodgers, Jr. et al. ..... 273/80 R
3,651,188 3/1972 Wolf ..... 273/80 R

FOREIGN PATENT DOCUMENTS 2605581 8/1976 Fed. Rep. of Germany ..... 280/819
1261541 1/1972 United Kingdom ..... 273/80 R

*Primary Examiner*—Paul J. Thibodeau

*Attorney, Agent, or Firm*—Wegner, Stellman, McCord, Wood & Dalton

[57] ABSTRACT

A ski pole shaft defined by a tubular element formed of a plurality of continuous filaments extending substantially rectilinearly end to end of the element and spaced in an annular array about the axis of element. The filaments are embedded in a matrix of set synthetic resin and are maintained in a longitudinally stressed condition by the set resin so as to define a prestressed tubular shaft wall.

The shaft wall may have an outer diameter of approximately 10 times the thickness of the wall. In one embodiment the wall has a thickness of approximately 0.07 inches. The filaments in the illustrated embodiment are stressed to approximately 5 to 10% of their breaking stress. The filaments in the illustrated embodiment comprise approximately 60 to 70% of the volume of shaft wall. The filaments may include filaments made of different materials and the different filaments may be selectively uniformly distributed in the annular array in the tubular wall. Alternatively the different material filaments may be arranged in radially related annular arrays. The outer surface of the tubular wall may be formed of the matrix material.

18 Claims, 5 Drawing Figures

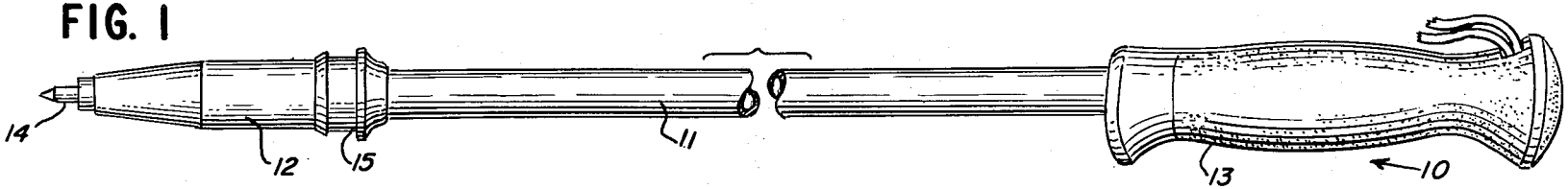
FIG. 1
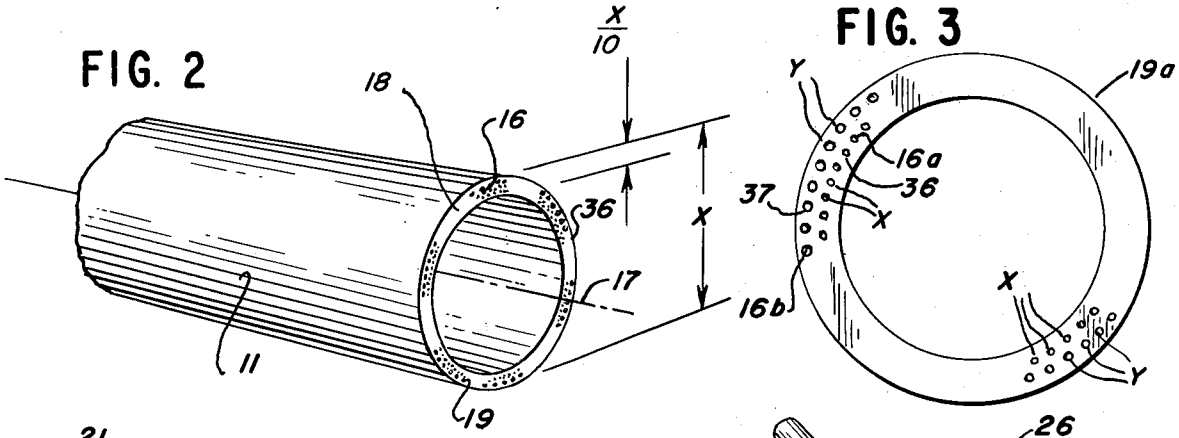
FIG. 2
FIG. 3
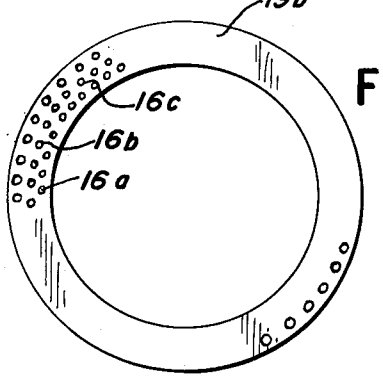
FIG. 4
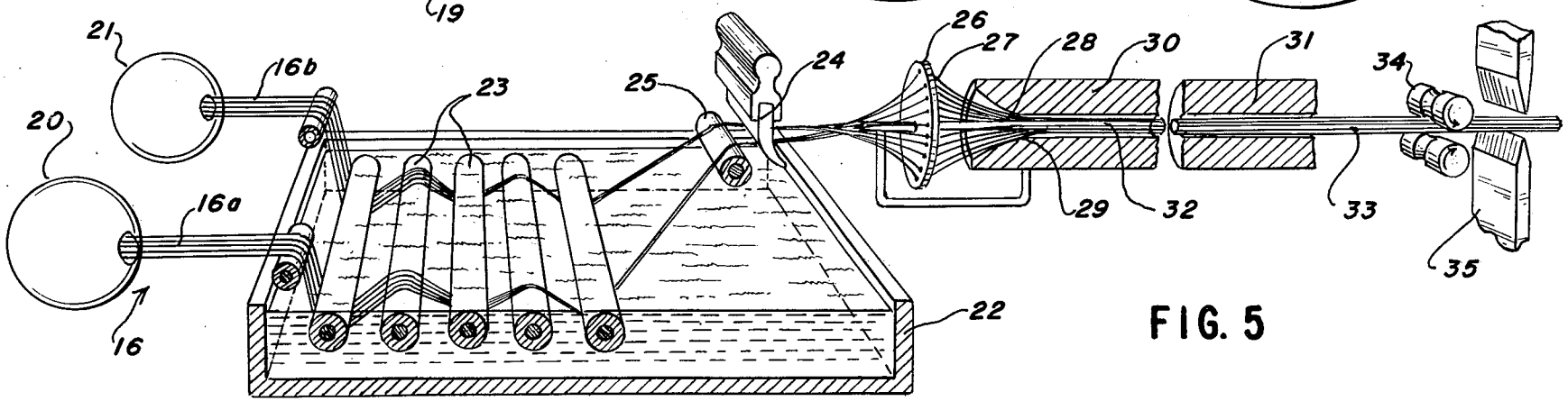
FIG. 5

SKI POLE SHAFT

This is a continuation of application Ser. No. 25,405 filed Mar. 30, 1979 now abandoned.

BACKGROUND OF THE INVENTION

1. Field of the Invention

This invention relates to ski pole structures and in particular to ski pole shaft constructions.

2. Description of the Prior Art

In the conventional ski pole a shaft is provided having a ferrule mounted at one end for carrying a basket and a tip, and a grip mounted at the other end. The shafts take a substantial strain in the use of the ski pole and wide range of materials has heretofore been utilized in forming such ski pole shafts.

A number of problems have arisen in the construction of the prior art ski pole shafts. Prior art shafts have been relatively expensive. In a number of the prior art constructions, such as where the shafts are formed of synthetic resins, breaking and cracking of the shafts has presented a problem.

In one form of prior art shafts reinforcing filaments have been arranged in a helical, or wrapped, distribution in a matrix of synthetic resin material.

SUMMARY OF THE INVENTION

The present invention comprehends an improved low cost ski pole shaft, wherein a synthetic resin matrix is reinforced by a plurality of continuous filaments extending substantially rectilinearly end to end of the tubular shaft.

The filaments are distributed in an annular array about the axis of the tubular element. The filaments may be distributed in a single array. Alternatively, the filaments may be provided in a number of annular arrays, the filaments of each array being formed of materials differing from that of the other arrays.

The filaments are maintained in a longitudinally stressed condition by the set matrix resin material to define a prestressed tubular shaft wall.

Illustratively, the filaments may be stressed to approximately 5 to 10% of their breaking stress.

Illustratively the shaft wall may have a thickness in the range of approximately 0.05" to 0.10".

Illustratively the shaft wall may have an outer diameter of approximately 10 times the thickness thereof.

In the illustrated embodiment the filaments comprise approximately 60 to 70% of the volume of the shaft wall.

The outer surface portion of the shaft wall may be formed of the synthetic resin matrix material.

Illustratively, the filaments may be formed of glass, Kevlar, carbon, etc. The matrix material illustratively may comprise a polyester resin.

The shaft of the present invention is extremely simple and economical of construction, while yet providing a highly improved, strong, break resistant ski pole shaft construction.

BRIEF DESCRIPTION OF THE DRAWING

Other features and advantages of the invention will be apparent from the following description taken in connection with accompanying drawing wherein:

FIG. 1 is a broken side elevation of a ski pole provided with a shaft embodying the invention;

FIG. 2 is a fragmentary perspective view of a ski pole shaft embodying the invention;

FIG. 3 is an enlarged end view of the ski pole shaft;

FIG. 4 is an enlarged end view of a modified form of ski pole shaft embodying the invention; and FIG. 5 is a schematic view illustrating a pultrusion method of forming the ski pole shaft of the present invention.

DESCRIPTION OF THE PREFERRED EMBODIMENT

In the illustrative embodiment of the invention as disclosed in the drawing, a ski pole, generally designated 10, is shown to include a ski pole shaft 11 embodying the invention, and having a ferrule 12 mounted to one end and a hand grip 13 mounted to the other end thereof. The ferrule may be provided with a conventional tip 14 and a suitable annular mounting portion 15 for mounting a suitable basket (not shown). The present invention is concerned with the construction of shaft 11 and illustrated ferrule hand grip and tip are exemplary only.

As indicated briefly above, shaft 11 comprises an improved tubular element which may be formed of a plurality of continuous filaments 16 extending substantially rectilinearly end to end of the tubular element. As shown in FIG. 2, the filaments may be spaced in an annular array about the axis 17 of the tubular element. The filaments are embedded in a matrix 18 of set synthetic resin and are maintained in a longitudinally stressed condition by the set resin matrix to define a prestressed tubular shaft wall 19.

As shown in FIG. 2, the thickness of the shaft wall may be approximately one-tenth the outer diameter of the tubular element 11 so as to define a lightweight, strong ski pole shaft construction.

The tubular shaft element 11 may be formed by a pultrusion process, as illustrated in FIG. 5. More specifically as shown therein, the filaments 16 may be provided in the form of a plurality of tows from suitable supply rolls 20 and 21. As will be obvious to those skilled in the art, the filaments may be provided from a single roll where the filaments 16 are formed of similar material in the annular array in the shaft wall. However, the invention comprehends that the filament may be formed of different materials and thus, illustratively, the filaments **16*a* of roll 20 may be formed of a first material, whereas the filament 16*b* of roll 21 may be formed of a second different material. As will be obvious to those skilled in the art, additional rolls may be provided if it is desired to provide additional different types of filament material in the distributed array of the filaments in the shaft wall 19**.

The filaments are coated with the synthetic resin in liquid form by passing the filaments through a suitable coating bath 22 which may be provided with conventional rollers 23 for guiding the filaments into and out of the liquid resin bath in a number of passes so as to thoroughly wet the filaments with the resin material. A blade 24 may be provided at a final roll 25 for pressing the matrix material against the filaments so as to assure complete wetting of the individual filaments by the matrix material prior to the delivery thereof to a guideplate 26 provided with a plurality of apertures 27 distributed in an annular array about the axis of a rod mandrel 28.

The filaments pass from the guideplate apertures into a funnel-shaped entrance 29 of a molding member 30 having a through bore 31, the mandrel 28 defining an inner end portion 32 coaxially received in the bore 31.

Thus, the resin coated filaments are guided into the annular space between mandrel portion 32 and the wall of the mold member 30 defining the bore 31 so as to form a tubular shaft wall having the filaments distributed in an annular array therein and extending substantially rectilinearly parallel to the axis of the mandrel 28 and the bore 31. The matrix material is effectively set within the mold member 30 in the pultrusion process so that the formed tubular wall 33 passing from the mold 30 at the right hand end thereof (as seen in FIG. 5) may be pulled by suitable pulling rollers 34 so as to maintain a preselected stress on the coated filaments 16 as they are drawn into the funnel entrance bore portion 29 to form the shaft wall in the mold 30. Thus the filaments are placed under a stressed condition which is maintained in the set matrix material of the formed shaft wall 33 so as to define a prestressed shaft wall.

In the illustrated embodiment the filaments are stressed to approximately 5 to 10% of their breaking stress, it being obvious to those skilled in the art that other suitable stressed conditions may be employed within the scope of the invention.

The set, continuously formed shaft wall may be suitably cut into desired discrete lengths by conventional cutting tools 35 so as to define the prestressed tubular ski pole shaft element 11, as shown in FIG. 1.

The invention comprehends that the outer surface portion 36 of the shaft wall be formed of the synthetic resin matrix material and such construction is advantageously effected by the method of forming of the shaft as shown in FIG. 5. In the illustrated embodiment, the shaft wall may have a thickness in the range of approximately 0.05" to 0.10". In one improved shaft wall construction embodying the invention, the wall had a thickness of approximately 0.07", the outer diameter of the shaft wall being approximately 0.580".

The filaments may comprise a substantial portion of the volume of the shaft wall. Illustratively the filaments comprise approximately 60 to 70% of the volume of the shaft wall. The filaments may be formed of suitable high tensile strength materials, such as glass, synthetic resins, such as Kevlar (a polyaramid resin of E. I. duPont wherein at least 85% of the polyamide constituent is attached directly to two aromatic rings), graphite carbon, etc. Illustratively, where the filaments are formed of glass, they may comprise filaments having a diameter of approximately 0.047" and arranged in tows comprising 60 ends per roving, with approximately 26 rovings being utilized in the shaft construction. The rovings may have a weight of approximately 0.004# per foot, so that the shaft construction is relatively lightweight while yet provides high strength and break-resistance in the ski pole.

The matrix material may comprise a polyester resin, one excellent example of a polyester resin advantageously adapted for such use being that manufactured by Coppers Co. Inc., Pittsburgh, Pa., identified as Dion 8101 Pultrusion Resin System Material. The liquid resin preferably has a viscosity of approximately 1000 centipoise, the viscosity being adjusted by use of suitable fillers. As will be obvious to those skilled in the art, control of the setting time may be effected by use of suitable catalysts. The pultrusion process is well known in the art and is advantageously adapted for use in forming the improved shafts 11.

As shown in FIG. 2, the filaments may be uniformly distributed in a single annular array in the shaft wall 19. Alternatively, as illustrated in FIG. 3, filaments **16*a* may be provided in an inner annular array 36 and filaments 16*b* may be provided in an outer matrix array 37. Illustratively, the inner filaments may be formed of the synthetic resin such as Kevlar and the outer filaments may be formed of glass. Thus the shaft wall 19*a* of FIG. 3 permits facilitated pigmentation of the shaft 11**.

Alternatively, as illustrated in FIG. 4, a shaft wall **19*b* may be provided wherein a plurality of filaments formed of different materials such as filaments 16*a*, 16*b* and 16*c*, may be arranged and distributed in the tubular wall 19*b* as desired. Illustratively the filaments 16*a* may comprise Kevlar filaments, the filaments 16*b* may comprise glass filaments, and the filaments 16*c*** may comprise carbon graphite filaments.

The invention comprehends that the filaments be maintained in prestressed condition by the set matrix material so as to provide an improved low cost, high strength, break resistant ski pole shaft construction. The use of the pultrusion process as illustrated in FIG. 5 assures the high quality, maintained accurate shaft construction at extremely low cost.

The foregoing disclosure of specific embodiments is illustrative of the broad inventive concepts comprehended by the invention.

I claim:

1. A thin wall ski pole shaft comprising:

a tubular element formed of a plurality of longitudinally stressed high tensile strength continuous filaments extending end to end of the element and spaced in an annular array about the axis of the element; and a matrix of set synthetic resin embedding said filaments, said filaments being maintained in the longitudinally stressed condition by said set resin matrix to define a longitudinally prestressed thin wall tubular shaft wall having a thickness in the range of approximately 0.05" to 0.10" and an outer diameter of approximately 10 times the thickness of the wall, said filaments comprising a major portion of the shaft wall.

2. The ski pole shaft of claim 1 wherein said filaments are formed of polyaramid resin.

3. The ski pole shaft of claim 1 wherein said shaft wall has a thickness of approximately 0.07".

4. The ski pole shaft of claim 3 wherein said shaft wall has an outer diameter of approximately 0.580".

5. The ski pole shaft of claim 1 wherein said filaments are stressed to approximately 5 to 10% of their breaking stress.

6. The ski pole shaft of claim 1 wherein said filaments are formed of glass.

7. The ski pole shaft of claim 1 wherein said filaments are formed of synthetic resin.

8. The ski pole shaft of claim 1 wherein said filaments are formed of carbon.

9. The ski pole shaft of claim 1 wherein said filaments comprise approximately 60% to 70% of the volume of the shaft wall.

10. The ski pole shaft of claim 1 wherein said resin comprises a polyester resin material.

11. The ski pole shaft of claim 1 wherein the outer surface portion of the tubular element comprises synthetic resin matrix material.

12. The ski pole shaft of claim 1 wherein said filaments are stressed to at least approximately 5% of their breaking stress.

13. A thin wall ski pole shaft comprising:

a tubular element formed of a plurality of continuous high tensile strength filaments extending end to end of the element and spaced in an annular array about the axis of the element, said plurality of filaments including first filaments formed of a first material and second filaments formed of a second material; and a matrix of set synthetic resin embedding said filaments, said filaments being maintained in a longitudinally stressed condition by said set resin matrix to define a longitudinally prestressed thin wall tubular shaft wall having a thickness in the range of approximately 0.05" to 0.10" and an outer diameter of approximately 10 times the thickness of the wall, said filaments comprising a major portion of the shaft wall.

14. The ski pole shaft of claim 13 wherein said first and second filaments are uniformly distributed in said annular array.

15. The ski pole shaft of claim 13 wherein said first filaments are distributed in a radially outer annular array and said second filaments are distributed in a radially inner annular array.

16. The ski pole shaft of claim 13 wherein said first filaments comprise glass filaments distributed in a radially outer annular array and said second filaments are distributed in a radially inner annular array.

17. The ski pole shaft of claim 13 wherein said first filaments comprise synthetic resin filaments distributed in a radially outer annular array and said second filaments are distributed in a radially inner annular array.

18. The ski pole shaft of claim 13 wherein said filaments are arranged in spaced tows in said tubular element.

* * * * *